US008727317B2

(12) United States Patent
Lindner et al.

(10) Patent No.: US 8,727,317 B2
(45) Date of Patent: May 20, 2014

(54) RESCUE CYLINDER

(75) Inventors: Dietmar Lindner, Eckersdorf (DE); Carsten Sauerbier, Lauf an der Pegnitz (DE)

(73) Assignee: Lukas Hydraulik GmbH, Erlangen (DE)

( * ) Notice: Subject to any disclaimer, the term of this patent is extended or adjusted under 35 U.S.C. 154(b) by 61 days.

(21) Appl. No.: 13/113,559

(22) Filed: May 23, 2011

(65) Prior Publication Data

US 2012/0298940 A1 Nov. 29, 2012

(51) Int. Cl.
*A62B 3/00* (2006.01)
*B66F 3/24* (2006.01)

(52) U.S. Cl.
CPC . *A62B 3/00* (2013.01); *A62B 3/005* (2013.01); *B66F 3/24* (2013.01)
USPC ..... 254/93 H; 254/89 H; 29/278

(58) Field of Classification Search
USPC ..... 254/DIG. 1, DIG. 3, DIG. 4, 93 R–93 H; 29/239; 72/453.01, 457, 705; 92/DIG. 3; 269/24–32
See application file for complete search history.

(56) References Cited

U.S. PATENT DOCUMENTS 732,696 A * 7/1903 Barnes ..... 173/128
2,200,133 A * 5/1940 Mandl ..... 72/54
2,483,239 A * 9/1949 Sharpe ..... 91/167 R
2,754,804 A * 7/1956 Miller ..... 173/36
3,395,561 A * 8/1968 Lague et al. ..... 72/308
3,518,864 A * 7/1970 Salvatore et al. ..... 72/302
3,891,187 A * 6/1975 Bearden, Jr. ..... 254/93 R
4,706,343 A * 11/1987 Neidigk ..... 24/68 R
4,783,053 A * 11/1988 Yirmiyahu et al. ..... 254/93 R
5,060,502 A * 10/1991 Kuhlmann et al. ..... 72/392
5,337,428 A * 8/1994 Krauska et al. ..... 5/611

(Continued)

OTHER PUBLICATIONS

Hydraulic-definition. http://www.merriam-webster.com/dictionary/hydraulic. Retrieved: Oct. 6, 2013.*

(Continued)

*Primary Examiner* — Lee D Wilson
*Assistant Examiner* — Tyrone V Hall, Jr.
(74) *Attorney, Agent, or Firm* — Hamre, Schumann, Mueller & Larson, P.C.

(57) ABSTRACT

The present invention relates to a portable rescue cylinder (1) having a hydraulic cylinder (2) which is operated hydraulically and which can extend, said hydraulic cylinder having a first end and a second end opposite the same, wherein a force is generated by means of enlargement of the distance between the first and the second ends, having a hydraulic tank (3), having a pump (4) for driving the hydraulic cylinder (2), having a power source for supplying the pump (4) with power, and having a switch device (6) for the operation of the hydraulic cylinder (2). In order to provide a device which is as comfortable as possible and has small dimensions, it is suggested that the hydraulic tank and the pump should be integrated components of the rescue cylinder. Particularly, the hydraulic tank (3) and the pump (4) are located in a housing (7) which is located directly on the rescue cylinder (1) and/or the hydraulic cylinder (2).

21 Claims, 8 Drawing Sheets

(56) References Cited

U.S. PATENT DOCUMENTS

Figure 1:
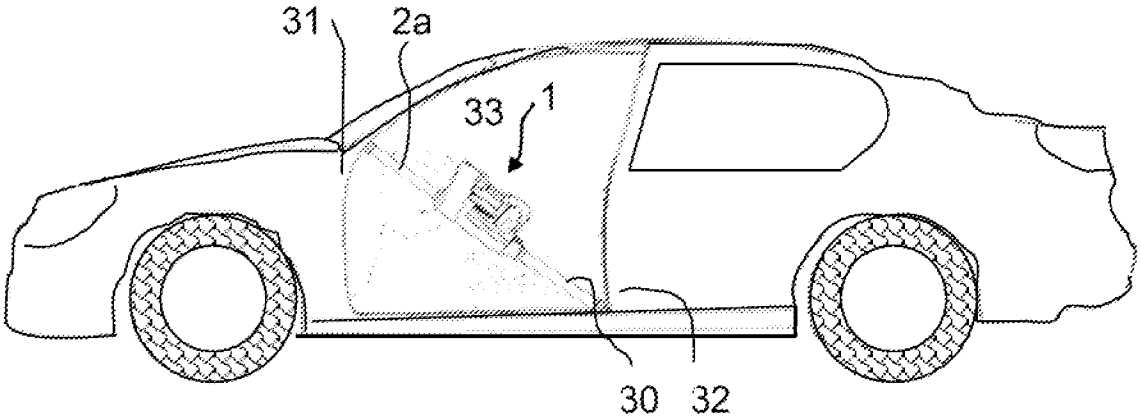

| | | | | | |
|---|---|---|---|---|---|
| 5,388,808 | A * | 2/1995 | Laitre | 254/35 |
| 5,398,773 | A * | 3/1995 | Baker | 173/90 |
| 5,542,646 | A * | 8/1996 | Bunyan | 254/93 R |
| 5,769,394 | A * | 6/1998 | Yirmiyahu et al. | 254/93 R |
| 5,904,340 | A * | 5/1999 | Allamon | 254/93 H |
| 5,992,826 | A * | 11/1999 | Simmonds | 254/103 |
| 6,357,724 | B1 * | 3/2002 | Hung | 254/8 B |
| 6,679,092 | B2 * | 1/2004 | Irii | 72/457 |
| 6,877,200 | B2 * | 4/2005 | Villarreal | 29/402.08 |
| 6,916,013 | B2 * | 7/2005 | Cardona | 254/93 R |
| 7,490,813 | B1 * | 2/2009 | Weddle | 254/93 R |
| 2008/0093587 | A1 * | 4/2008 | Sodini | 254/124 |

OTHER PUBLICATIONS

Hurst Jaws of Life "Product Catalog," (Jun. 2009), p. 1-31.

Hurst Jaws of Life "Streamline Technology, High Pressure," (Oct. 2008), p. 1-55.

Lukas, Because You Never Get a Second Chance, "It's Time for Superior Equipment, Rescue Equipment Catalogue." (Feb. 2010). p. 1-71.

Lukas, Passion Makes the Difference, "Battery Powered Combi Tool LKE 55," LUKAS Hydraulik GmbH, Postfach 2560-91013 Erlangen, Weinstraβe 39, Erlangen, 91058, Germany, p. 1-6.

Holmatro, "Rescue Equipment Rettungsgeräte," (Oct. 2, 2005). p. 1-27.

* cited by examiner

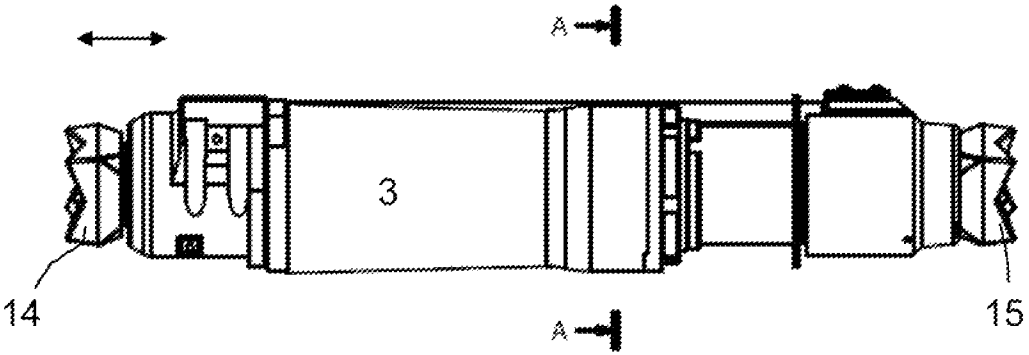
Fig. 6A
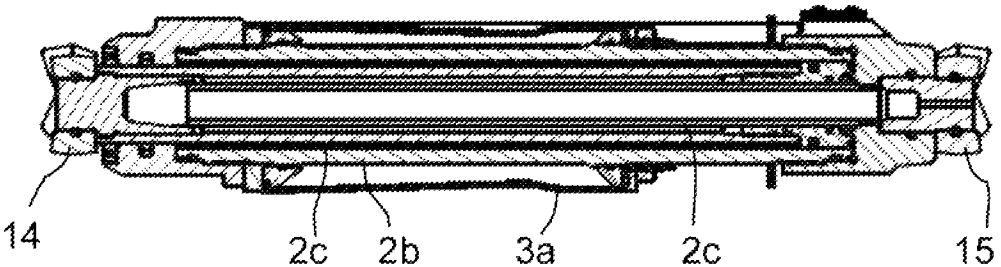
Fig. 6B
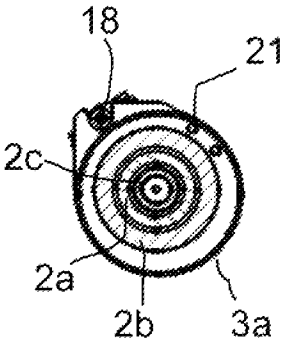
Fig. 6C
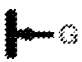

RESCUE CYLINDER

The present invention relates to a portable rescue cylinder for use by rescue personnel for the purpose of rescuing persons trapped by auto accidents, natural disasters, and the like. In cases of an auto accident, such rescue cylinders are used between the B column and the A column of a vehicle, for example, wherein the rescue cylinder is operated for the purpose of increasing the distance between the A column and the B column—that is, to spread the same apart—such that a person trapped in the interior of the vehicle can be pulled out of the vehicle. Because the conditions for the actual use of the rescue cylinder typically include very narrow spaces, the usability, compactness, and operating comfort of such a rescue cylinder are particularly significant.

PRIOR ART

Rescue cylinders according to the prior art have a hydraulic cylinder which is operated hydraulically and which can extend, wherein said hydraulic cylinder has a high-pressure side and a low-pressure side, and has a first end and a second end opposite the same. The distance between said ends is altered by the extension of the piston rod of the hydraulic cylinder, and a spreading force can be generated in this way. A switch device is located directly on the hydraulic cylinder and is operated manually for the purpose of controlling the operation of the hydraulic cylinder, said switch device being connected to a pump assembly via connection hoses, wherein said pump assembly contains the hydraulic tank. The pump assembly is typically a motor pump having an internal combustion engine, or is an electrically operated pump assembly. The separate pump assembly leads to significant restrictions in the freedom of use of the rescue cylinder, because, for example, it is hard to position in cases where space is limited, or very long hydraulic hose connections are necessary between the rescue cylinder and the pump assembly. Moreover, a second person must be present to monitor the pump assembly. In addition, a significant amount of space is taken up, and a significant amount of weight must be carried, in order to keep the assembly and the hoses ready in the rescue vehicle.

Problem Addressed by the Present Invention

The problem addressed by the present invention is that of providing a novel rescue cylinder which offers improved operating comfort and consequently can lead to a faster rescue.

Solution to the Problem

The present problem is solved by a portable rescue cylinder having a hydraulic cylinder which is operated hydraulically and which can extend, said hydraulic cylinder having a first end and a second end opposite the same, wherein a force is generated by means of enlargement of the distance between the first and the second ends. The rescue cylinder has a hydraulic tank, a pump for driving the hydraulic cylinder, a power source for supplying the pump with power, and a switch device for the operation of the hydraulic cylinder. The hydraulic tank and the pump are integrated components of the rescue cylinder. Such a rescue cylinder has no restrictions on the operation thereof inherent in a separate pump assembly, and inherent to hoses which must be connected thereto, or inherent in a separate hydraulic tank, and as such ensures increased operating comfort and improved use options.

According to the invention, the rescue cylinder has a housing which is made of one or multiple parts, wherein the hydraulic tank and the pump are arranged in said housing. As such, the hydraulic tank and the pump are located directly in the working device, and additional functional elements can be arranged in the housing. At the same time, the pump and the hydraulic tank are protected from outside influences.

The hydraulic tank is advantageously located in a position in the housing of the rescue cylinder on the connection line between the first and the second ends of the hydraulic cylinder. This configuration ensures a compact construction, a convenient center of gravity, and comfortable usability.

Likewise, the fact that the housing has a long side and a short side and/or height, the same being positioned perpendicular to the long side, and the long side of the housing runs substantially parallel to the longitudinal axis of the hydraulic cylinder, also ensures that the housing does not interfere with the use of the device.

According to the invention, the housing is designed with a U- or V shape, wherein the carry grip is located between the two legs, preferably inside the U and/or V. This configuration both offers protection for the hand of the operator when said hand is holding the carry grip, and also likewise contributes to the compactness of the rescue cylinder.

Because the carry grip runs substantially parallel to the longitudinal axis of the hydraulic cylinder, the rescue cylinder can be easily positioned.

Advantageously, the housing has two housing shells with a junction plane running in a longitudinal direction with respect to the hydraulic cylinder.

Because the hydraulic tank has at least one flexible tank chamber, e.g. a rubber tank, the same being arranged on the hydraulic cylinder and surrounding the same at least over a partial section of the circumference thereof, it is possible to achieve a particularly compact dimensioning of the rescue cylinder, and also create a convenient center of gravity, thereby improving the operating comfort of the device. The flexible tank chamber serves the purpose of compensating for volume variations due to operation of the device, by means of the flexibility of said tank chamber.

In order to ensure the flexibility of the tank chamber, the same can be constructed of a flexible outer wall and a flexible inner wall, such that the tank chamber curves around the hydraulic cylinder like a hollow-walled sheath.

As an alternative, the flexible tank chamber can be formed by an outer flexible wall and by an outer surface of the cylinder body.

Advantageously, the flexible tank chamber formed in this way can be attached on one end thereof in the area of an end of the longitudinally extended tank chamber to the hydraulic cylinder by means of an attachment ring. This configuration creates a construction which is simple to realize.

For the purpose of sealing the flexible tank chamber onto the side lying opposite the attachment ring, a reinforcement ring can be included, the same being likewise made of rubber or plastic, or also out of metal, for example.

According to the invention, wall spacers are provided inside the flexible tank chamber, for example in the form of rods which extend in the longitudinal direction. The same prevent the flexible walls of the tank chamber from coming into contact with each other when hydraulic fluid flows out of the chamber, and therefore prevent the development of adhesive forces resulting in a binding effect.

Preferably, the flexible tank chamber, the attachment ring, the reinforcement ring, and the wall spacers can be constructed as an integrated component assembly. The flexible wall can be vulcanized onto the attachment ring and/or onto the reinforcement ring.

Because a peripheral area of the hydraulic cylinder is not covered by the hydraulic tank, it is possible for the pressure pipe to run along the hydraulic cylinder very near to the same, thereby achieving a compact construction.

As an alternative, the hydraulic tank can also be arranged in a manner which is offset eccentrically with respect to the hydraulic cylinder, in order to achieve the same effect.

Advantageously, the rescue cylinder according to the invention has at least one illumination device, for example on the front and rear sides thereof, for the purpose of illuminating the working area. As an alternative or in addition thereto, the device can also include an illumination device for the battery slot, for the purpose of ensuring that the battery can be changed without a problem when the device is used in darkness. Advantageously, the illumination devices are supplied with power by the power source which also supplies the pump with power.

The power source can be a battery or an external source of current in the form of a power supply unit with an electrical outlet plug.

For this purpose, the housing of the rescue cylinder can have a shared connection slot which is suitable for both the use of a battery and the use of a power supply unit. If the connection slot is arranged in such a manner that it runs in the transverse direction perpendicular to the hydraulic cylinder longitudinal axis, then the battery can be easily changed during operation, because it is not necessary to pull out the same in the direction in which the device is working, i.e. in the direction of the spreading force.

Advantageously, the claws are constructed on both sides of the rescue cylinder, and are able to rotate. In this way, the housing can pivot during use of the device, in order to compensate for obstacles and similar problems.

Advantageously, the hydraulic cylinder is located in a lower area, for example in a position occupying the lower third of the housing. In this way, the hydraulic cylinder can move into especially close proximity with the object or with an engagement point, such as a door window sill of a vehicle.

DESCRIPTION OF THE INVENTION WITH REFERENCE TO EMBODIMENTS

Figure 2:
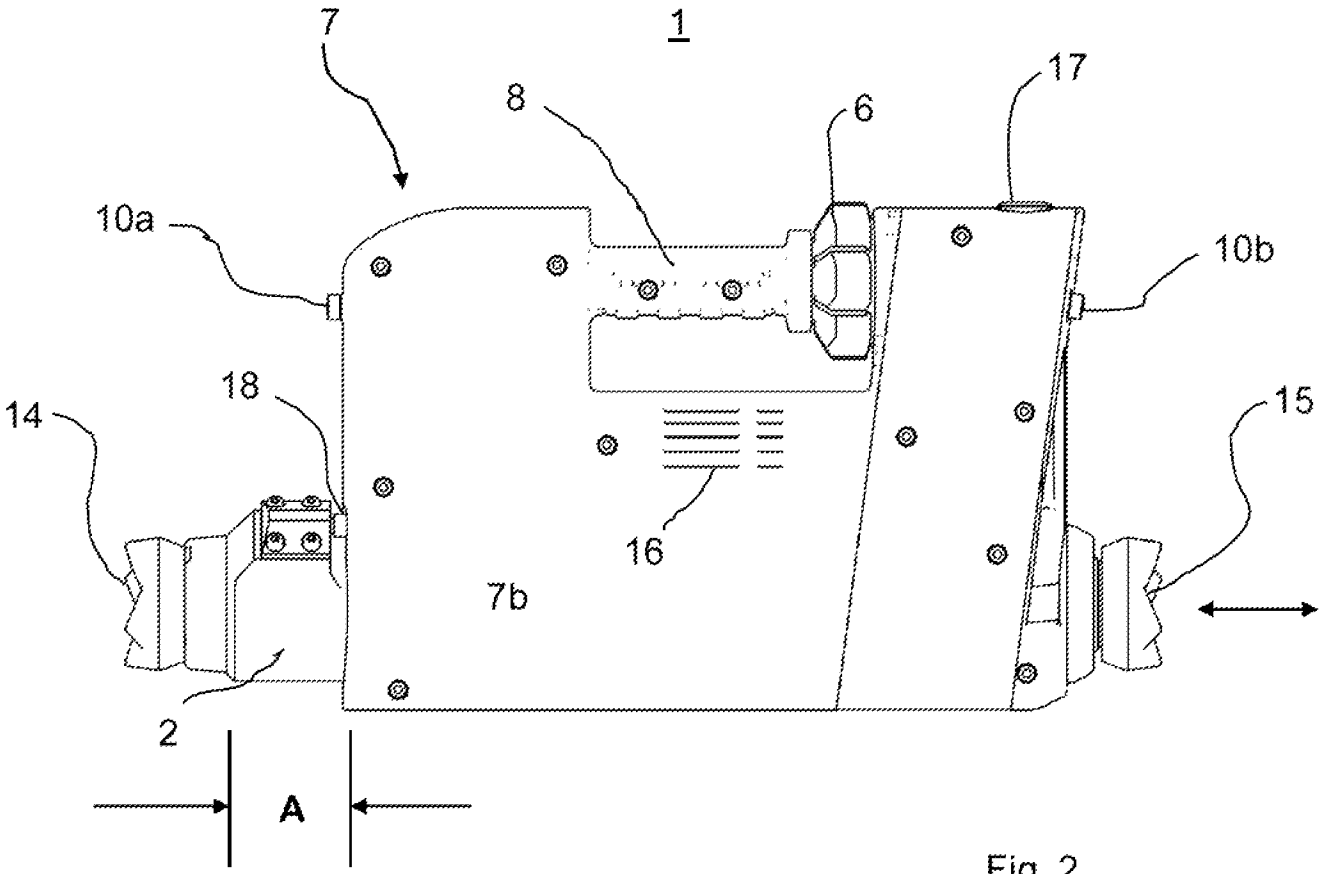
Figure 3:
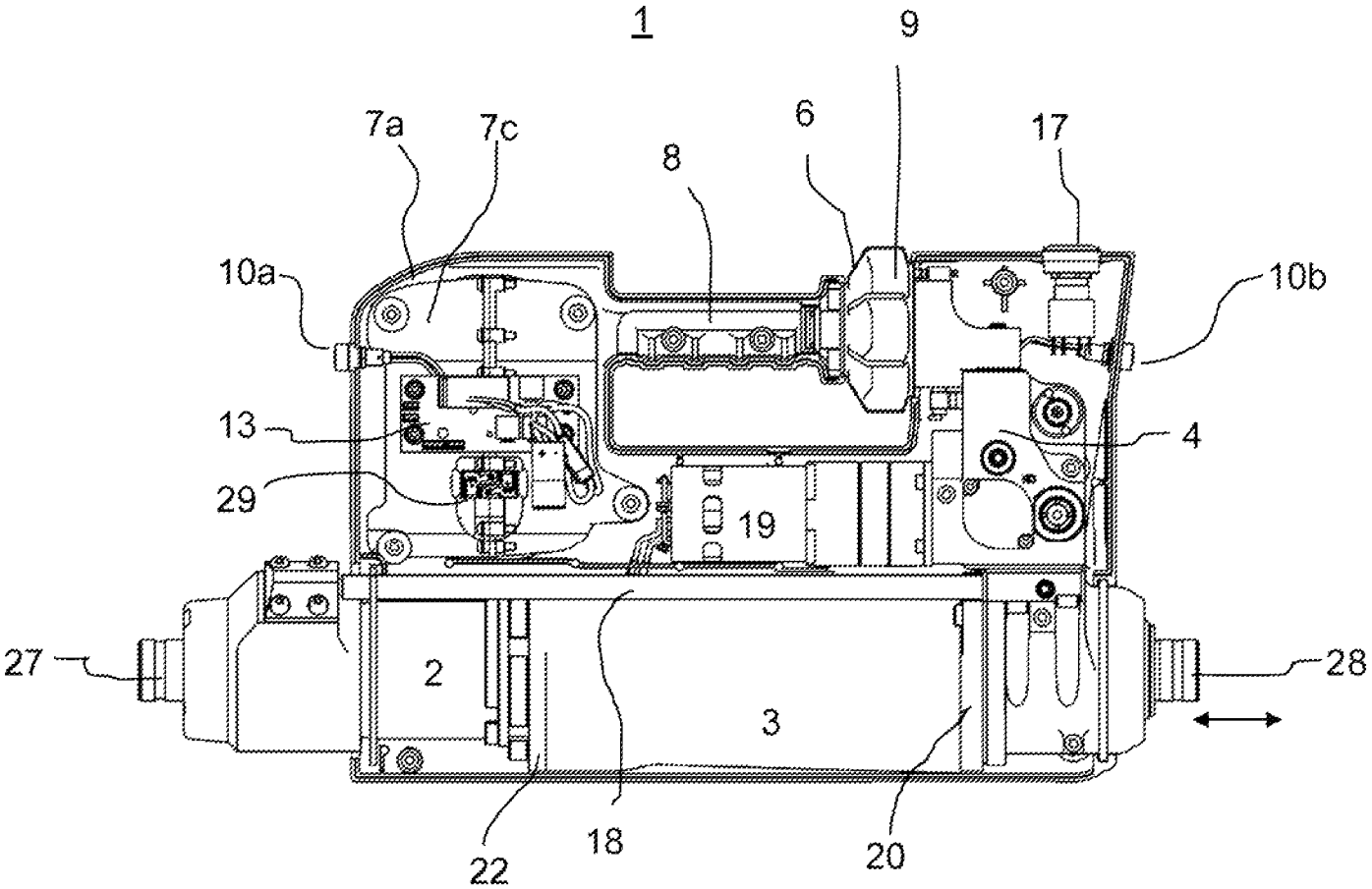
Figure 4:
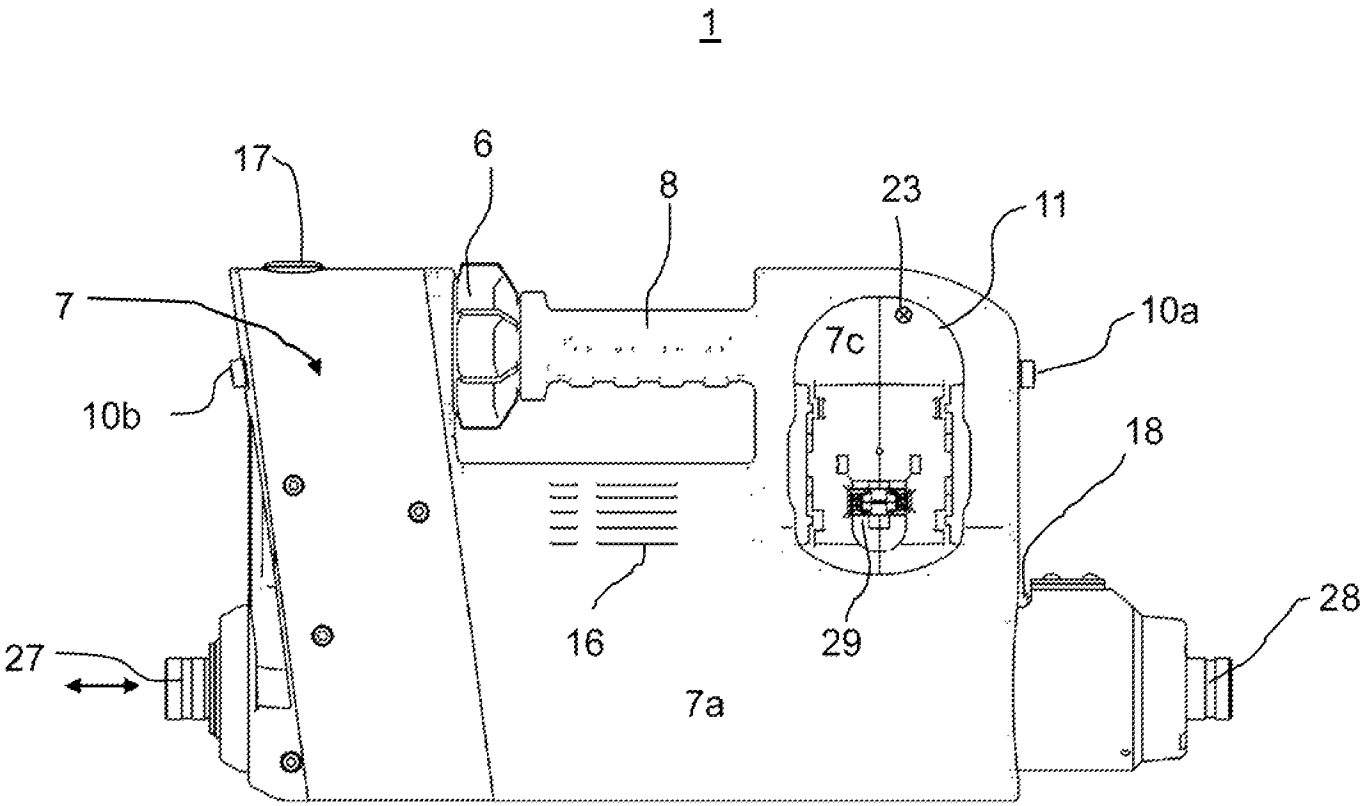
Figure 5B:
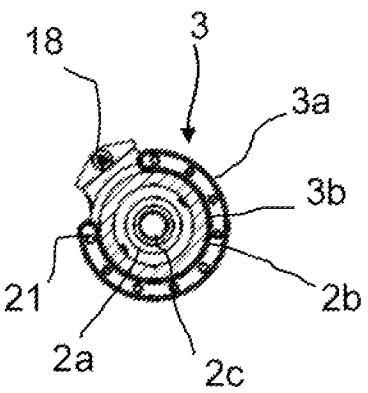
Figure 5A:
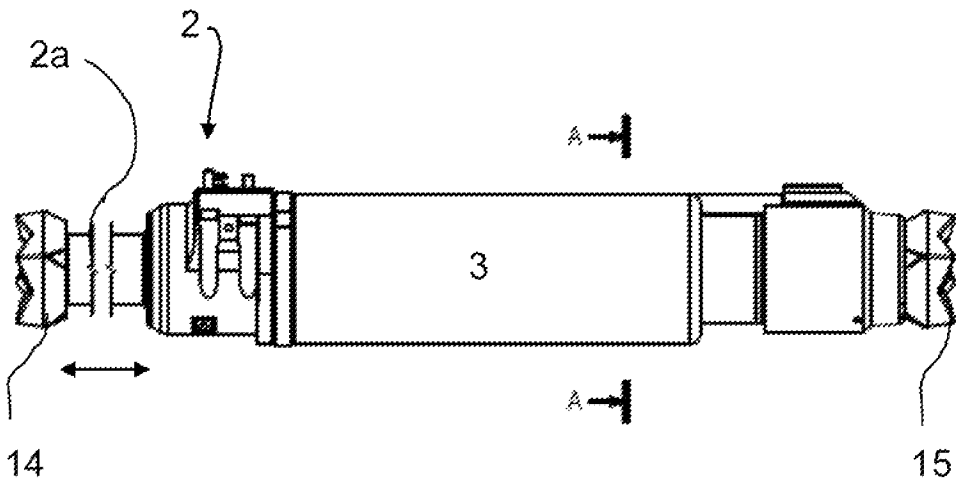
Figure 7C:
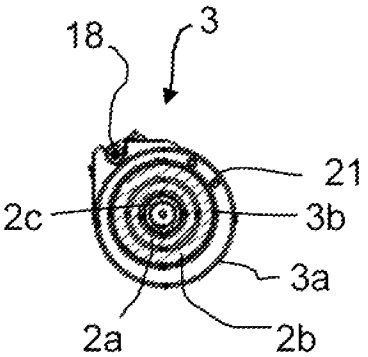
Figure 7A:
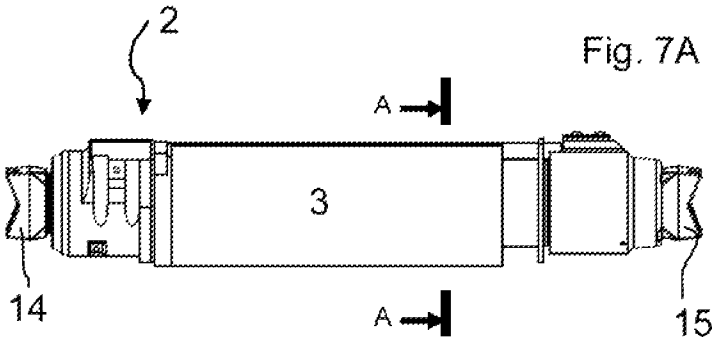
Figure 7B:
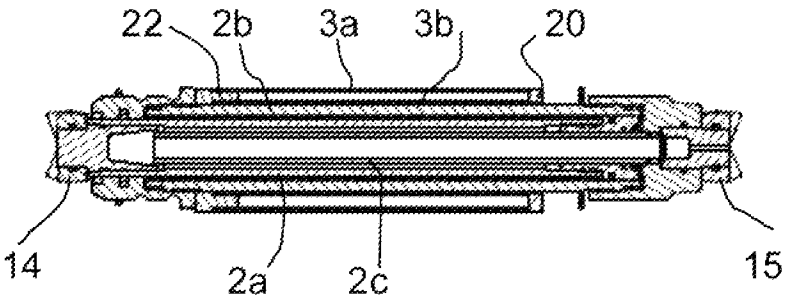
Figure 8B:
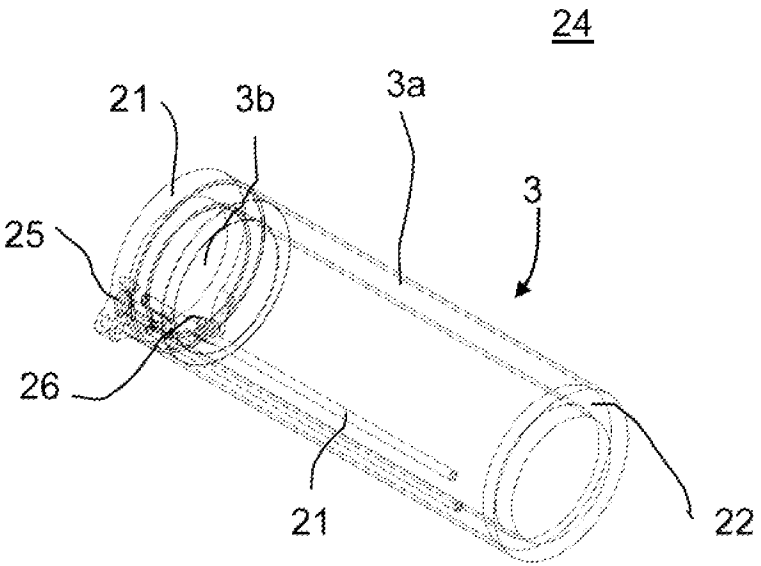
Figure 8A:
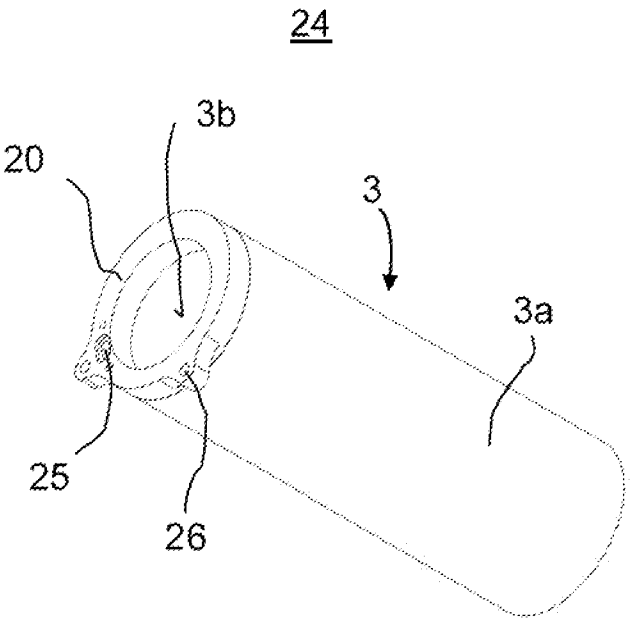

Advantageous embodiments of the present invention are explained below with reference to the illustrations. The following figures are included:

FIG. 1 a very simplified schematic illustration of an embodiment of the rescue cylinder according to the invention, during use;

FIG. 2. an enlarged side view of the rescue cylinder according to FIG. 1;

FIG. 3 an internal view of the rescue cylinder according to FIG. 2, with the housing half shell opened:

FIG. 4 a view of the opposite side of the rescue cylinder according to FIG. 2;

FIG. 5 a first embodiment of the hydraulic tank according to the invention in a top view thereof (FIG. 5A), as well as in a cross section along a cut plane A-A from FIG. 5A (FIG. 5B);

FIG. 6. a further embodiment of the hydraulic tank in a top view (FIG. 6A), shown in a longitudinal section (FIG. 6B), as well as in a cross section along the line A-A in FIG. 6A (FIG. 6C);

FIG. 7 a further embodiment of the hydraulic tank in a top view (FIG. 7A), shown in a longitudinal section (FIG. 7B), as well as in a cross section along the line A-A in FIG. 7A (FIG. 7C), and FIG. 8 a perspective view of the hydraulic tank component assembly (FIG. 8A), as well as a transparent view thereof (FIG. 8B).

FIG. 1 shows the rescue cylinder 1 according to the invention, the same in use in a crashed vehicle for the purpose of rescuing a person (not illustrated) who is trapped therein. Typically, the front end of a vehicle involved in a collision or in a rollover is severely deformed. Particularly, in these cases, the vehicle front end, along with the A column 31 which is attached thereto, is typically deformed, such that the passengers are trapped in the cabin 33. In order to rescue the passengers, a rescue cylinder 1 is inserted, depending on the amount of available space, in the lower corner between the B column 32 and the door window sill. For this purpose, as illustrated in FIG. 1, a connector piece and/or extension piece 30 can be connected to the rescue cylinder 1. The piston rod 2*a* is extended on the opposite side of the rescue cylinder 1 by means of operation of said connector piece, until the piston rod 2*a* engages with the deformed A column 31. By means of further operation of the rescue cylinder 1, the A column 31 is forced outward, i.e. to the upper left of the figure, and the passenger cabin 33 is thereby enlarged. The deformation resulting from an accident can be significant, such that only very little space is available for the rescue cylinder 1 to be inserted, and the freedom of movement for operating the rescue cylinder 1 is very limited. The compactness and ease of operation of the rescue cylinder 1 is therefore of very decisive importance.

As is indicated in FIG. 2, the rescue cylinder 1 according to the invention has a hydraulic cylinder 2 located in the lower third of the housing 7, and the hydraulic cylinder 2 has a claw 14 and/or 15 on each end thereof. A simple hydraulic cylinder body, that is, a hydraulic cylinder body having only one piston rod, can be used as the hydraulic cylinder body; however, a telescoping hydraulic cylinder body can also be used, the same having multiple piston rods which can travel inside each other. The displaceable end of the hydraulic cylinder 2 shown in FIG. 2 is located on the right side thereof in FIG. 2, and has a claw 15. An extension piece can be used on the left end thereof, the same corresponding to the extension piece 30 shown in FIG. 1. The claw 14 is then located at the end of the extension piece 30. The housing 7 consisting of two housing shells is located at a separation distance from the left claw 14 via an additional separation distance A, in order to prevent negative influences on the housing 7 in the event that the left claw 14 penetrates the material during operation.

The housing 7 is constructed with a U shape, wherein both legs of the U are connected by a slightly recessed carry grip 8, as well as by a switch device 6 in the form of a gear wheel which is located in the extension of the carry grip 8. The housing 7 is provided with ventilation slits 16, and has an illumination device 10*b* on the front side thereof for the frontal work area, as well as an illumination device 10*a* for the rearward work area. Both illumination devices 10*a* and 10*b* are supplied with power by the primary power source of the rescue cylinder 1. The master switch 17 is located in the upper part of the housing 7. The housing 7 has an overall elongated shape which is nearly rectangular, wherein the long side of the housing 7 runs parallel to the longitudinal axis of the hydraulic cylinder 2, and in addition, the hydraulic cylinder 2 is located in the lower third of the housing 7.

FIG. 3 shows one of the opened housing shells 7*a* of the rescue cylinder 1 according to FIG. 1. Rods 27, 28 for attaching the claws 14 and/or 15 are provided on both sides of the hydraulic cylinder 2. Both of the claws 14, 15 are attached to the rods 27, 28 and/or to the extension piece 30 in such a manner that both claws can rotate on the hydraulic cylinder 2. In this way, the position of the housing 7 with respect to the rotation thereof can be modified to any degree during operation. The hydraulic tank 3 is located in a position in the connection line between both rods 27, 28 with respect to the longitudinal extension of the longitudinal axis of the hydraulic cylinder 2. The hydraulic tank 3 is a flexible tank, for example a rubber tank, which surrounds the cylinder body of the hydraulic cylinder 2 in a curved manner. The hydraulic tank 3 is connected to an attachment ring 20, which extends around the cylinder body of the hydraulic cylinder 2, and is equipped with a feed line for the supply and/or the removal of the hydraulic fluid.

A pressure hose 18 runs parallel to the hydraulic cylinder 2, and hydraulic fluid can be conveyed via said pressure hose 18 into the pressure chamber arranged at the left side of FIG. 3 (not shown), as well as into the annular space of the hydraulic cylinder 2 positioned at the right side of FIG. 3 (not shown). The pressure hose 18 is likewise located inside the housing 7.

The reference numeral 19 in FIG. 3 indicates an electric drive and/or an electric motor, which is connected to a hydraulic pump arrangement 4, and which drives the same. The hydraulic pump arrangement has multiple lines (not shown), which run to the hydraulic cylinder 2 and/or to the pressure hose 18 via a valve block 9 arranged in a switch device 6. The valve block 9 can be operated manually, for example by means of a gear wheel as illustrated in FIG. 3 at the end of the hand grip 8, the same connecting the front and rearward housing parts to each other. It is possible to extend, retract, and/or hold the piston rod of the hydraulic cylinder 2 by rotating the gear wheel, i.e. the switch device 6. The master switch 17 is located on the upper side of the housing 7, and the rescue cylinder 1 can be started and/or shut down by means of said master switch 17.

Furthermore, illumination devices 10*b* and/or 10*a* for the purpose of illuminating the work area in darkness are provided on both the front side and the rear side. One and the same power source supplies power to both the electric drive 19 and the illumination devices 10*a* and 10*b*.

The novel rescue cylinder 1 additionally has a control panel 13 with electronic components which are necessary for the operation of the functional parts of the rescue cylinder according to the invention.

The control panel 13 is located on a separate housing wall 7*c*, which forms the rear wall of a connection slot 11 for a battery (see FIG. 4). The electric drive 19 is located below the hand grip 8, such that the heat generated by the electric drive 19 can dissipate to the outside through the ventilation slits 16 (see FIG. 2). Reference numeral 29 indicates the connection contact for the battery or for a power supply unit. The latter can be inserted into the connection slot in place of the battery.

As is indicated in FIG. 4, the connection slot 11 for the battery and/or for a power supply unit is located in the side area of the housing 7, such that the working area, that is the area being forced opened, is not affected by a change of the battery, because manipulation of the battery and/or the power supply unit is carried out laterally thereto. Both claws 14 and 15 (see, e.g., FIG. 2) are affixed to and can each rotate on the rods 27 and 28, such that the housing 7 of the rescue cylinder 1 can be pivoted when necessary about the rotational axis formed by the two rods 27, 28. Due to the lateral arrangement of the connection slot 11, many degrees of freedom of movement are possible in conditions of severely restricted space.

In order to simplify the change of batteries, even at night or under challenging light conditions, an additional illumination device 23 is provided in the connection slot 11, and is likewise supplied with power by the power source of the electric drive.

A battery (not shown) serves as the power source, and is preferably a lithium-ion battery. The battery is covered, at least substantially, by the connection slot 11, and therefore does not interfere when the rescue cylinder 1 is manipulated. The battery can be replaced if possible by a power supply unit, the same being connected to the power supply unit or to a generator. The power supply unit is likewise inserted into the connection slot 11.

FIGS. 5A and B show a first embodiment of the hydraulic tank 3 of the rescue cylinder 1 of the present invention. The hydraulic tank 3 has a flat, elongated, and curved tank chamber which extends around the hydraulic cylinder 2 and has an outer wall 3*a* as well as an inner wall 3*b*. The outer wall 3*a* and/or the inner wall 3*b* are made of a flexible material, e.g. in the form of a flexible membrane, and therefore are capable of fitting tightly over the hydraulic cylinder 2, and also of compensating for volume changes occurring during operation.

Wall spacers 21 in the form of long rods are located inside the tank. These prevent parts of the outer wall 3*a* from contacting the inner wall 3*b*, which can lead to the same adhering to each other.

As is indicated in FIG. 5B, the tank chamber of the hydraulic tank 3 only extends over part of the circumference thereof (approx. ¾ of the circumference). The pressure hose 18 runs very close to the hydraulic cylinder 2 in the recessed area, which contributes to the compactness of the rescue cylinder 1 according to the invention. As is indicated in FIG. 5A, little additional space is required by the curved tank chamber.

The tank chamber lies on the outer surface of the cylinder body 2*b* (see FIG. 5B). The piston rod 2*a* extends through the interior of the cylinder body 2*b*. The return hose 2*c* is located inside the piston rod 2*a*. The tank chamber in this embodiment is positioned concentrically about the central axis of the hydraulic cylinder 2.

In the embodiment of the hydraulic tank 3 according to FIG. 6A-C, the tank chamber is bounded on the inside thereof by the outer surface of the cylinder body 2*b*, and on the outside thereof by a flexible wall 3A. Two wall spacers 21 are located inside the tank chamber (see FIG. 6C) and ensure that the outer flexible wall 2A cannot move into contact with the surface of the cylinder body 2*b*. Moreover, the tank chamber so formed is arranged in such a manner that the central axis thereof is eccentric to the central axis of the hydraulic cylinder 2. Due to said eccentric arrangement, it is possible to nevertheless position the pressure hose 18 (see FIG. 6C) as close as possible to the hydraulic cylinder 2 given a tank volume surrounding the same, whereby the rescue cylinder according to the invention can be constructed in an especially compact manner.

FIGS. 7A-C show a further embodiment of the design of the hydraulic tank 3 for the rescue cylinder 1 according to the invention. In this embodiment a flexible tank chamber formed by an outer flexible wall 3*a* and an inner flexible wall 3*b* is provided, as in the embodiment illustrated in FIGS. 5A and B. As is indicated in FIG. 7C, the tank chamber is likewise arranged over the entire circumference; however, it is positioned with the central axis thereof displaced with respect to the central axis of the hydraulic cylinder 2. In this way, it is also possible for the pressure hose 18 to be arranged as close as possible to the hydraulic cylinder 2. The hydraulic tank 3 according to FIG. 7 also has an attachment ring 20, as well as a reinforcement ring 22 on the opposite side.

FIG. 8 shows the component assembly 24 of the hydraulic tank 3 of the embodiment according to FIG. 7A-7C. As is indicated in FIG. 8A, the component assembly 24 comprises the attachment ring 20 made of metal, the same closing the gap between the outer flexible wall 3*a* and the inner flexible wall 3*b* at one end thereof. The reinforcement ring 22 (not shown in FIG. 8A) is located at the other end. The reinforcement ring 22 closes the gap on the opposite side. The attachment ring 20 has two attachment bore holes 26 for the purpose of fixing the hydraulic tank 3 laterally on the outer periphery of the hydraulic cylinder 2. In addition, an orifice 25 is provided in the attachment ring 20 and is connected to the hydraulic feed network of the rescue cylinder. Wall spacers are not illustrated in FIG. 8A for purposes of clarity.

As is indicated in FIG. 8B, rod-shaped wall spacers 21 extend longitudinally inside the tank chamber from the attachment ring on one end nearly to the opposite end of the hydraulic cylinder 3. They function to prevent the flexible walls in 3*a* and/or 3*b* from adhering to each other.

As is indicated in FIG. 8B, the reinforcement ring 22 is located on the side opposite the attachment ring 20.

The reinforcement ring 22 and the attachment ring 20 can be vulcanized to the orifice 25 and to the attachment bore holes 28 for the purpose of producing the component assembly. The wall spacers 21 are attached in the area of the attachment ring 20 in an advantageous manner.

LIST OF REFERENCE NUMBERS

1 rescue cylinder
2 hydraulic cylinder
2*a* piston rod (hydraulic cylinder)
2*b* cylinder body (hydraulic cylinder)
2*c* return hose (hydraulic cylinder)
3 hydraulic tank
3*a* outer tank membrane (hydraulic tank)
3*b* inner tank membrane (hydraulic tank)
4 pump
5 battery
6 switch device
7 housing
7*a* housing shell
7*b* housing shell
7*c* housing wall
8 carry grip
9 valve block
10 illumination device
10*a* illumination device rear side
10*b* illumination device front side
11 connection slot
12 power supply unit
13 control panel
14 claw
15 claw
16 ventilation slit
17 master switch
18 pressure hose
19 electric drive
20 attachment ring
21 wall spacer
22 reinforcement ring
23 battery slot illumination
24 hydraulic tank component assembly
25 orifice
26 attachment bore holes
27 rod
28 rod
29 connection contact (battery/power supply unit)
30 extension piece
31 A column (vehicle)
32 B column (vehicle)
33 passenger cabin

The invention claimed is:

1. A rescue cylinder for portable use, comprising:
a hydraulic cylinder which is manually controllable and which can axially extend, said hydraulic cylinder having a first end and a second end opposite thereto, the cylinder generating a separating force by increasing the distance between the first and the second ends thereof,
a hydraulic tank,
a pump and a motor for driving the pump, said motor and said pump for applying hydraulic pressure to the hydraulic cylinder,
a battery for providing power to the motor,
a switch device for manually operating the hydraulic cylinder, wherein
the hydraulic tank, the motor and the pump are integrated components of the rescue cylinder
wherein the hydraulic tank cuts a connection line between the first and the second ends of the hydraulic cylinder.

2. A rescue cylinder for portable use, comprising:
a hydraulic cylinder which is manually controllable and which can axially extend, said hydraulic cylinder having a first end and a second end opposite thereto, the cylinder generating a separating force by increasing the distance between the first and the second ends thereof,
a hydraulic tank,
a pump and a motor for driving the pump, said motor and said pump for applying
hydraulic pressure to the hydraulic cylinder,
a battery for providing power to the motor,
a switch device for manually operating the hydraulic cylinder, wherein
the hydraulic tank, the motor and the pump are integrated components of the rescue cylinder
wherein the rescue cylinder has a housing, and the hydraulic tank, the motor and the pump are located in the housing, said housing having a U shape or a V shape thereby creating legs, said housing further having a carry grip arranged between the legs of the U or V.

3. A rescue cylinder according to claim 2, wherein the carry grip runs substantially parallel to the longitudinal axis of the hydraulic cylinder.

4. A rescue cylinder for portable use, comprising:
a hydraulic cylinder which is manually controllable and which can axially extend, said hydraulic cylinder having a first end and a second end opposite thereto, the cylinder generating a separating force by increasing the distance between the first and the second ends thereof,
a hydraulic tank,
a pump for applying hydraulic pressure to the hydraulic cylinder,
a power source for providing power to the pump,
a switch device for manually operating the hydraulic cylinder,
wherein the hydraulic tank and the pump are integrated components of the rescue cylinder, and
wherein the hydraulic tank has at least one flexible tank chamber which extends around a part of the circumference of the hydraulic cylinder.

5. A rescue cylinder according to claim 4, wherein the flexible tank chamber has a flexible outer wall as well as a flexible inner wall.

6. A rescue cylinder according to claim 4, wherein the hydraulic cylinder has a cylinder body and the flexible tank chamber is formed by a flexible outer wall and the cylinder body.

7. A rescue cylinder according to claim 4, wherein the flexible tank chamber is attached near one end of the hydraulic cylinder with an attachment ring.

8. A rescue cylinder according to claim 7, wherein the flexible tank chamber has a reinforcement ring on an end area opposite the attachment ring.

9. A rescue cylinder according to claim 8, wherein wall spacers are provided inside the flexible tank chamber.

10. A rescue cylinder according to claim 9, wherein the flexible tank chamber, the attachment ring, the reinforcement ring, and the wall spacers are designed as one component assembly.

11. A rescue cylinder according to claim 4, wherein a circumferential area of the hydraulic cylinder is not covered by the hydraulic tank.

12. A rescue cylinder for portable use, comprising:

a hydraulic cylinder which is manually controllable and which can axially extend, said hydraulic cylinder having a first end and a second end opposite thereto, the cylinder generating a separating force by increasing the distance between the first and the second ends thereof, a hydraulic tank, a pump and a motor for driving the pump, said motor and said pump for applying hydraulic pressure to the hydraulic cylinder, a battery for providing power to the motor, a switch device for manually operating the hydraulic cylinder, wherein the hydraulic tank, the motor and the pump are integrated components of the rescue cylinder wherein claws can rotate on both sides of the rescue cylinder.

13. A rescue cylinder for portable use, comprising:

a hydraulic cylinder having first and second ends and a longitudinal axis, said first and second ends being longitudinally opposite one another and which during operation at least one of said ends extends away from the other end and can thereafter contract toward the other end;

hydraulic components including;

a hydraulic tank, a motor, a pump, and a valve block wherein the hydraulic cylinder, the hydraulic tank, and the pump are operably connected with the valve block so that the valve block controls hydraulic operation of the hydraulic cylinder, a battery as a power source for driving the motor and the pump, and a housing for substantially enclosing at least some of said hydraulic components, the housing having a long side oriented substantially parallel to the longitudinal axis of the hydraulic cylinder, wherein said housing includes a carry grip which is substantially parallel to the longitudinal axis of the hydraulic cylinder wherein the housing has a U shape or a V shape and the carry grip is arranged between both legs of the U or V.

14. A rescue cylinder for portable use, comprising:

a hydraulic cylinder having first and second ends and a longitudinal axis, said first and second ends being longitudinally opposite one another and which during operation at least one of said ends extends away from the other end and can thereafter contract toward the other end;

hydraulic components including;

a hydraulic tank, a motor, a pump, and a valve block wherein the hydraulic cylinder, the hydraulic tank, and the pump are operably connected with the valve block so that the valve block controls hydraulic operation of the hydraulic cylinder, a battery as a power source for driving the motor and the pump, and a housing for substantially enclosing at least some of said hydraulic components, the housing having a long side oriented substantially parallel to the longitudinal axis of the hydraulic cylinder, wherein said housing includes a carry grip which is substantially parallel to the longitudinal axis of the hydraulic cylinder wherein the hydraulic tank has at least one flexible tank chamber which extends around a part of the circumference of the hydraulic cylinder.

15. The rescue cylinder in accordance with claim 14, wherein the flexible tank chamber has a flexible outer wall as well as a flexible inner wall.

16. The rescue cylinder in accordance with claim 14, wherein the hydraulic cylinder has a cylinder body and the flexible tank chamber is formed by a flexible outer wall and the cylinder body.

17. The rescue cylinder in accordance with claim 14, wherein the flexible tank chamber is attached near one end of the hydraulic cylinder with an attachment ring.

18. The rescue cylinder in accordance with claim 17, wherein the flexible tank chamber has a reinforcement ring on an end area opposite the attachment ring.

19. The rescue cylinder in accordance with claim 18, wherein wall spacers are provided inside the flexible tank chamber.

20. The rescue cylinder in accordance with claim 19, wherein the flexible tank chamber, the attachment ring, the reinforcement ring, and the wall spacers are in unity as one component.

21. A rescue cylinder for portable use, comprising:

a hydraulic cylinder having first and second ends and a longitudinal axis, said first and second ends being longitudinally opposite one another and which during operation at least one of said ends extends away from the other end and can thereafter contract toward the other end;

claws attached to the first and second ends of the hydraulic cylinder, the claws being rotatable;

hydraulic components including;

a hydraulic tank, a motor, a pump, and a valve block wherein the hydraulic cylinder, the hydraulic tank, and the pump are operably connected with the valve block so that the valve block controls hydraulic operation of the hydraulic cylinder;

a battery as a power source for driving the motor and the pump; and a housing for substantially enclosing at least some of said hydraulic components, the housing having a long side oriented substantially parallel to the longitudinal axis of the hydraulic cylinder, wherein said housing includes a carry grip which is substantially parallel to the longitudinal axis of the hydraulic cylinder.

* * * * *